US005576050A

United States Patent [19]

Van Houwelingen et al.

[11] Patent Number: 5,576,050

[45] Date of Patent: Nov. 19, 1996

[54] METHOD OF CURING A FILM

[75] Inventors: Dirk Van Houwelingen; Johannes A. G. P. Damsteegt; Johannes M. A. A. Compen, all of Eindhoven, Netherlands

[73] Assignee: U.S. Philips Corporation, New York, N.Y.

[21] Appl. No.: 512,748

[22] Filed: Aug. 8, 1995

Related U.S. Application Data

[63] Continuation of Ser. No. 165,431, Dec. 10, 1993, abandoned.

[30] Foreign Application Priority Data

Dec. 17, 1992 [EP] European Pat. Off. ..... 92203982

[51] Int. Cl.[6] ..... B05D 5/06

[52] U.S. Cl. ..... 427/64; 427/68; 427/378; 427/389.7; 118/51

[58] Field of Search ..... 427/378, 64, 68, 427/348, 389.7; 118/58

[56] References Cited

U.S. PATENT DOCUMENTS

| | | | |
|---|---|---|---|
| 4,260,439 | 4/1981 | Speer | 427/348 |
| 4,336,279 | 6/1982 | Metzger | 427/378 |
| 5,001,026 | 3/1991 | Bozek et al. | 430/23 |
| 5,030,879 | 7/1991 | Derks | 313/346 R |
| 5,083,957 | 1/1992 | bolz et al. | 445/3 |
| 5,273,701 | 12/1993 | Marlin | 427/348 |

*Primary Examiner*—Janyce Bell
*Attorney, Agent, or Firm*—Norman N. Spain

[57] ABSTRACT

A film provided on a cathode ray tube is cured by locally subjecting it to a flow of very hot air. The gas flow heats the film without heating the underlying display window. Said gas flow is used to scan the surface.

21 Claims, 2 Drawing Sheets

METHOD OF CURING A FILM

This is a continuation of application Ser. No. 08/165,431, filed Dec. 10, 1993, now abandoned.

FIELD OF THE INVENTION

The invention relates to a method of curing a film on a surface of a part of a cathode ray tube.

Cathode ray tubes are used in, inter alia, television receivers, computer monitors and oscilloscopes.

Background of the Invention

A method of the type mentioned in the opening paragraph is known. A film is provided on a surface of the display window. Said film is sprayed on the surface in the liquid condition, and is subsequently dried and cured. Customarily, the film is cured in a furnace. The film hardens as a result of the high temperature in the furnace. It takes approximately 30 minutes to 1 hour to cure the film. This method is less suitable for mass production. In a production line the aim is to harmonize the durations of the process steps with each other. This enables a display window or display tube to be subjected sequentially and "in-line" to the different process steps. A typical average duration of a process step is approximately 1 minute. If the duration of a process step is much longer than the average duration, this process step cannot be applied "in-line", because the velocity in the production line is generally governed by the slowest process step. The process step in question must be carried out outside the production line. Thus, the display window or display tube must be removed from the production line and an arrangement enabling said process step to be carried out outside the production line is required. This results in an increase of the production costs and a higher risk of breakage.

SUMMARY OF THE INVENTION

An object of the invention is to provide a method of the type mentioned in the opening paragraph, which is more suitable for "in-line" application.

To this end, the method in accordance with the invention is characterized in that the film is cured by a hot gas flow which is blown onto a limited surface area of the film and which "scans" the surface.

The invention is based on the insight that by means of a hot gas flow the part of the film in said area can be cured within a few seconds. It has been found that by scanning the surface with the gas flow the film can be cured in a period of time in the range from ten seconds to several minutes. Preferably, the temperature of the gas flow exceeds 500° C. At lower temperatures the curing process takes more time. The movement of the gas flow over the surface has the advantage that the part itself, for example the display window, is heated only slightly. Only the film and the top layer of the surface (the portion located directly below the film) are subject to a substantial increase in temperature. As a result, thermal stresses hardly, if at all, occur. Thus, breakage as a result of thermal stresses is precluded. The latter advantage is important, in particular, in embodiments of the method in accordance with the invention, wherein the film is provided on the outside of a part of an evacuated cathode ray tube, for example the outside of the display window of an evacuated display tube or the outside of the cone of an evacuated display tube. In general, an evacuated display tube cannot be subjected to very high temperatures for a prolonged period of time. In the known method, the temperature of the display tube and hence the temperature of the furnace must not exceed temperatures in the range from 100° C. to 200° C. At higher temperatures there is a substantial risk of breakage of the evacuated display tube. In the method in accordance with the invention, the temperature in the part of the film which is subjected to the gas flow amounts to several hundred degrees Celsius. However, the temperature of the display window or the cone is much lower. The last-mentioned advantage is also important for, in particular, display tubes having a display window with a diagonal in excess of 50 cm. The larger the tubes, the longer it takes to heat the tubes in a furnace to the desired temperature, and the risk of breakage increases.

An embodiment of the method in accordance with the invention is characterized in that the surface is substantially rectangular and in that the gas flow covers a strip-shaped area extending over the surface in a first direction, said gas flow being moved over the surface in a direction transversely to said first direction.

Consequently, the gas flow has to move in only one direction. This simplifies and accelerates the process. This embodiment can for example be used to provide a film on the inner or outer surface of a display window.

The invention further relates to a device for curing a film on a surface of a display window of or for a cathode ray tube.

The device in accordance with the invention is characterized in that it comprises means for blowing an air flow having a temperature in excess of 500° C. onto a specific area of the surface of the display window, as well as means for scanning the surface with the air flow.

BRIEF DESCRIPTION OF THE DRAWINGS

These and other aspects of the invention will be described in greater detail, by way of example, with reference to the accompanying drawing, in which.

The Figures are diagrammatic and not drawn to scale. In general, equal parts bear the same reference numerals.

DETAILED DESCRIPTION OF THE PREFERRED EMBODIMENTS

Figure 1:
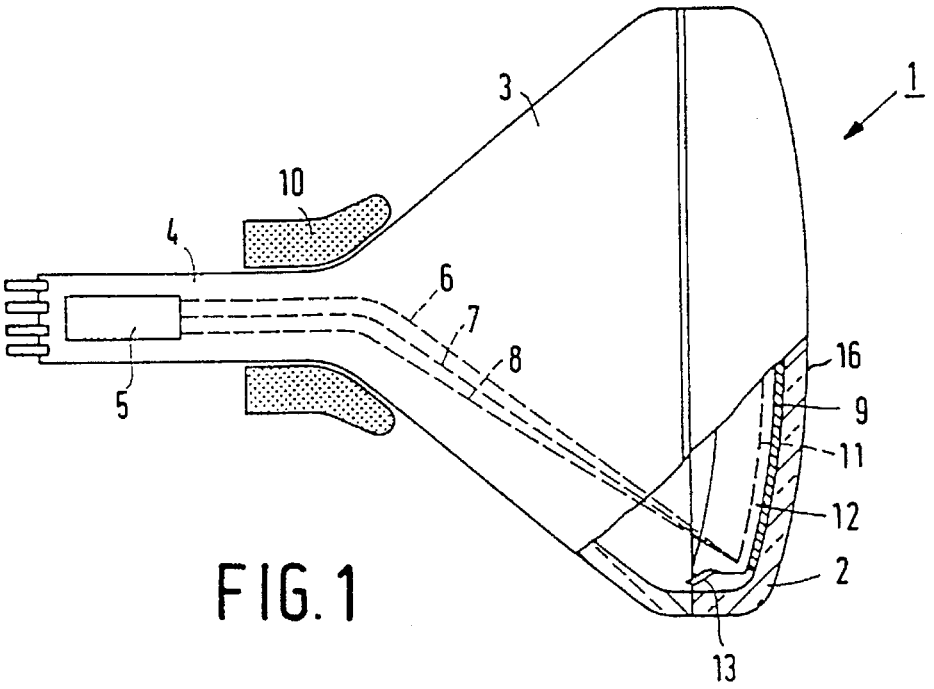
FIG. 1 shows a cathode ray tube.

FIG. 1 is a sectional view of a cathode ray tube, in this example a color cathode ray tube, having an evacuated envelope 1 which comprises a substantially rectangular display window 2, an enveloping portion 3 and a neck 4. In the neck them is provided an electrode system 5 for generating, in this case, three electron beams 6, 7 and 8. In this example, the electron beams are generated in one plane (the plane of the drawing) and are directed to an electroluminescent display screen 9 which is provided on the inside of the display window and which comprises a phosphor pattern consisting of a large number of phosphor elements luminescing in red, green and blue. The phosphor elements may be in the form of, for example, dots or lines. On their way to the display screen 9, the electron beams 6, 7 and 8 are deflected across the display screen 9 by means of a deflection unit 10 and pass through a color selection electrode 11 which is arranged in front of the display screen 9 and which comprises a thin plate with apertures 12. The three electron beams 6, 7 and 8 pass through the apertures 12 of the color selection electrode 11 at a small angle and, consequently, each electron beam impinges on phosphor elements of only one color. The color selection electrode 11 is suspended in front of the display screen by means of suspension means 13.

A surface of the display window, in this example the outer surface 16, is provided with a film. Such a film can be used as an anti-reflection film or as an antistatic film. In accordance with a known method, such a film is provided in the liquid condition, after which the film is dried and subsequently cured. Customarily, the film is cured in a furnace. As described above, such a method is less suitable for mass production because the process step in which the film is cured is generally unsuitable for "in-line" application. Besides, if the film is provided on a display tube which has already been evacuated, there is a substantial risk of breakage of the display tube. It is an object of the invention to provide a method in which the above drawbacks are reduced.

Figure 2:
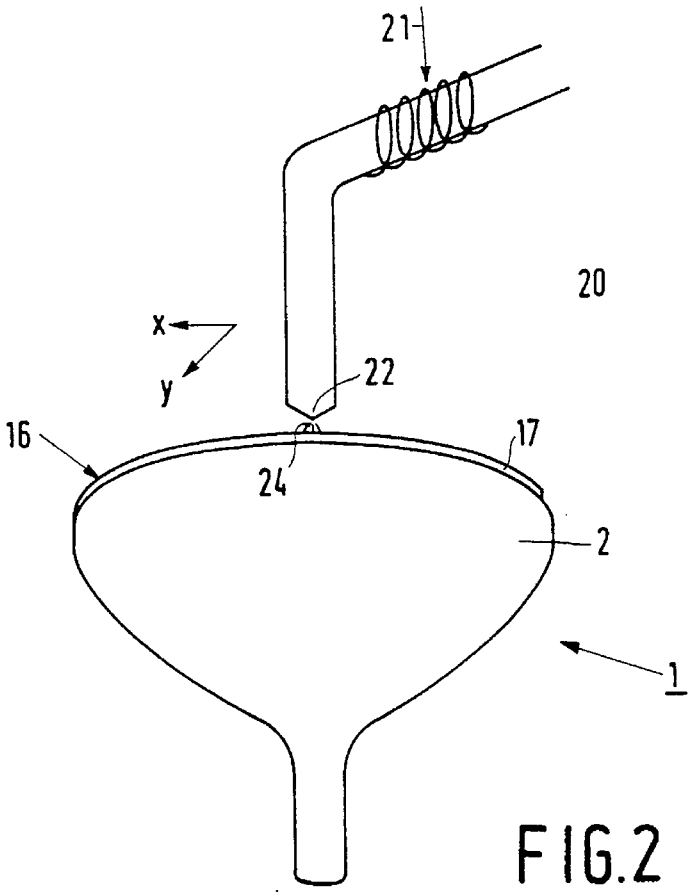
FIG. 2 shows the device in accordance with the invention and the method of the invention.

FIG. 2 illustrates the method. The display window 2 of an, in this example, evacuated display tube 1 is provided with a dried film 17 on the outer surface 16. A blowing device 20 is provided at some distance from the outer surface. Said blowing device comprises, in this example, means 21 for heating air to a temperature above 500° C. Said air is led to the nozzle 22. Said nozzle 22 of the blowing device 20 is arranged at some distance (for example 0.5 to 5 cm) from the film. The nozzle is moved relative to the outer surface, so that the film is scanned by the gas flow. This is diagrammatically shown in FIG. 2 by means of the x- and y-directions. Preferably, the temperature of the air ranges of from 700° to 1000° C. The higher the temperature of the air, the faster the film is cured. At temperatures above 1000° C., there is a relatively large risk that thermal stresses occur. In the above-indicated preferred temperature range, the film is cured rapidly and without a substantial risk of breakage. The film is cured in the area where the gas flow, in this example the air flow 24, heats the film 17. However, the temperature of the display window itself rises hardly, if at all. By virtue of the fact that the nozzle is moved relative to the surface the heat penetrates hardly, if at all, into the display window. In other words, the heat supply to the film is very large per unit mass of film, so that the temperature of the film increases in a short period of time (within a few seconds) to high values (several hundred degrees Celsius), causing the film to be cured; however, the heat supply to the display window, per unit mass of display window, is small, so that only a few, if any, thermal stresses occur in the display window.

Figure 3:
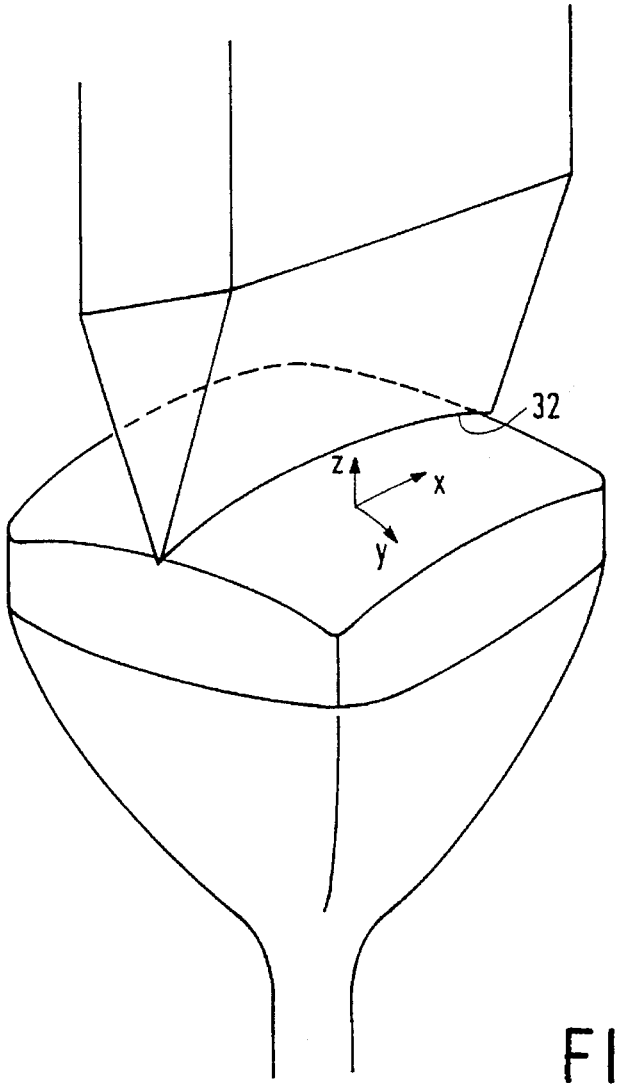
FIGS. 3 and 4 show further embodiments of the method and the device in accordance with the invention.

FIG. 3 shows a further embodiment of the method and the device in accordance with the invention. The nozzle 32 has a slit-shaped aperture extending in the x-direction. The nozzle 32 is moved over the surface in the y-direction or the surface is moved in the y-direction with respect to the nozzle. By virtue of the shape of the air flow (approximately strip-shaped), a movement in only one direction is necessary. This simplifies and accelerates the process and simplifies the device. In addition, the film is more homogeneously cured.

In a simple embodiment, the slit-shaped aperture is a straight slit. In the preferred embodiment shown in FIG. 3, the shape of the nozzle is adapted to the surface of, in this example, the display window which is not fiat, i.e. the slit-shaped aperture approximately follows the curvature of the display window. The distance between the slit-shaped aperture and the display window substantially does not vary along the aperture. This reduces temperature differences in the film during the curing process, resulting in a more homogeneously cured film. In a simple embodiment, the movement in the y-direction is carried out in a fiat plane in the z-direction. In a preferred embodiment, the device comprises means for keeping the distance between the nozzle and the surface at least substantially equal during the movement in the y-direction. This reduces the temperature differences in the film during the curing process and leads to a more homogeneous film. In the embodiment shown, an upward and downward movement in the z-direction is carried out during the movement in the y-direction.

Figure 4:
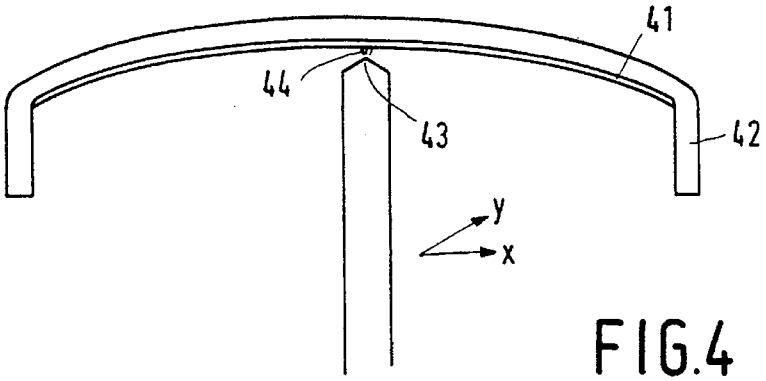

FIG. 4 shows a further embodiment of the method and the device in accordance with the invention. In this embodiment, a film 41 on the inside of the display window 42 is cured. A gas flow 44 emanating from the nozzle 43 is blown onto the film. Said nozzle and the display window are moved relative to each other in the x- and y-directions.

The method in accordance with the invention enables, for example, an anti-reflection layer to be provided on the inner surface or outer surface of the display window. To this end, for example, a Tetra Ethyl Orthosilicate (TEOS) or Tetra Ethyl Ortho Titanate (TEOTI) solution in an alcohol is sprayed on the surface, dried and cured in accordance with the inventive method. The resulting film is an $SiO_2$ or $TiO_2$ film.

For example a mixture is prepared from 4 grams of TEOS, 2 grams of HCL (1M) and 2 grams of ethanol. After 30 minutes this mixture is diluted with 100 ml of ethanol and 100 ml of 1-butanol. The solution thus formed is provided on the outer surface of a display window and, after drying, cured in accordance with the invention.

In a second example, a mixture is prepared from 20.6 gr of TEOTI, 85.8 gr of ethanol and 6.5 gr of HCL (6M). After half an hour this mixture is diluted with 113.4 ml of 1-butanol and 406.7 ml of butanol/ethanol in a ratio of 1:1. The solution thus formed is provided on the outer surface of a display window and, after drying, cured in accordance with the method of the invention.

The two above-mentioned examples relate to the application of anti-reflection films on the surface. However, the invention is not limited thereto. Also other films, such as films comprising conductive particles, for example antistatic or light-absorbing films, can be cured in accordance with the inventive method.

The invention can advantageously be used, in particular, for evacuated cathode ray tubes having a dimension of the display window, measured along its diagonal, in excess of 50 cm. The disadvantages of the known method increase as the dimensions of the tubes increase; such large tubes necessitate larger furnaces, more time to cure and the risk of breakage increases.

It will be obvious that within the scope of the invention many variations are possible to those skilled in the art.

For example, by means of the method of the invention, a film can be provided on the cone. It is also possible to use more than one nozzle, for example a row of nozzles. In a preferred embodiment, the method is carried out, for example, in such a manner that in addition to the hot gas flow a second gas flow of a lower temperature is blown onto the surface. In this manner, the increase in temperature of the part on which the film is provided, for example the display window, can be limited. The second gas flow causes the temperature to decrease.

We claim:

1. A method of curing a heat curable film on a surface of a part of a cathode ray tube, characterized in that the film is cured by a hot gas flow which is blown onto a limited surface area of the film and which scans the surface as a result of movement of at least one of said hot gas flow and said surface relative to the other.

2. A method as claimed in claim 1, characterized in that the film is provided on the outside of a part of an evacuated cathode ray tube.

3. A method as claimed in claim 2, characterized in that the film is provided on the outside of the display window of the evacuated cathode ray tube.

4. A method as claimed in claim 3 wherein the surface is substantially rectangular, and the gas flow covers a strip-shaped area extending over the surface in a first direction, said gas flow being moved over the surface in a direction transversely to the first direction.

5. A method as claimed in claim 3 wherein the temperature of the gas flow is in excess of 500° C.

6. A method as claimed in claim 3 wherein the size of the cathode ray tube, measured along the diagonal of the display window, is in excess of 50 cm.

7. A method as claimed in claim 2, characterized in that the film is provided on the outside of the cone of an evacuated cathode ray tube.

8. A method as claimed in claim 7 wherein the size of the cathode ray tube, measured along the diagonal of the display window, is in excess of 50 cm.

9. A method as claimed in claim 2, characterized in that the size of the cathode ray tube, measured along the diagonal of the display window, is in excess of 50 cm.

10. A method as claimed in claim 2 wherein the surface is substantially rectangular, and the gas flow covers a strip-shaped area extending over the surface in a first direction, said gas flow being moved over the surface in a direction transversely to the first direction.

11. A method as claimed in claim 2 wherein the temperature of the gas flow is in excess of 500° C.

12. A method as claimed in claim 1, characterized in that the surface is substantially rectangular, and in that the gas flow covers a strip-shaped area extending over the surface in a first direction, said gas flow being moved over the surface in a direction transversely to the first direction.

13. A method as claimed in claim 12, characterized in that the temperature of the gas flow ranges between 700° C. and 1000° C.

14. A method as claimed in claim 1, characterized in that the temperature of the gas flow is in excess of 500° C.

15. A device for curing a heat curable film on a surface having a curvature of a display window of or for a cathode ray tube without substantial deterioration of the film or cathode ray tube, wherein the device comprises means for blowing a hot gas flow having a temperature in excess of 500° C. onto a specific area of the surface of the display window, and means for scanning the surface with a gas flow by movement of at least one of said hot gas flow and said surface relative to the other, and wherein said means for blowing the hot gas flow approximately follows the curvature of the surface.

16. A device as claimed in claim 15, characterized in that the device comprises a slit-shaped nozzle for blowing a gas flow onto a specific area of the display window, and means for moving the nozzle and the surface relative to each other in a direction transversely to the slit-shaped nozzle.

17. A device as claimed in claim 16 wherein the device comprises means for keeping the distance between the nozzle and the surface at least substantially equal.

18. A device as claimed in claim 15, characterized in that the device comprises means for keeping the distance between the nozzle and the surface at least substantially equal.

19. A device for curing a heat curable film on a surface having a curvature of a display window of or for a cathode ray tube without substantial deterioration of the film or cathode ray tube, wherein the device comprises a slit-shaped nozzle for blowing a hot gas flow having a temperature in excess of 500° C. onto a specific area of the surface of the display window, and means for scanning the surface with a gas flow by movement of at least one of said hot gas flow and said surface relative to the other and wherein said slit-shaped nozzle follows approximately the curvature of the surface.

20. A device as claimed in claim 19 wherein the device comprises means for keeping the distance between the nozzle and the surface at least substantially equal.

21. A device for curing a heat curable film on a surface having a curvature of a display window of or for a cathode ray tube without substantial deterioration of the film or cathode ray tube, wherein the device comprises a slit-shaped nozzle for blowing a hot gas flow having a temperature in excess of 500° C. onto a specific area of the surface of the display window, and means for scanning the surface with a gas flow by movement of at least one of said hot gas flow and said surface relative to the other in a direction transversely to the slit-shaped nozzle, and wherein said slit-shaped nozzle follows approximately the curvature of the surface.

* * * * *